US007039980B2

(12) United States Patent
Van Der Meyden et al.

(10) Patent No.: US 7,039,980 B2
(45) Date of Patent: May 9, 2006

(54) POOL CLEANER

(75) Inventors: Hendrikus Johannes Van Der Meyden, Halfway House (ZA); Alexis Adrian Felipe Wadman, Bedfordview (ZA); Michael Edward Moore, Johannesburg (ZA)

(73) Assignee: Zodiac Pool Care, Inc., Pompano Beach, FL (US)

( * ) Notice: Subject to any disclaimer, the term of this patent is extended or adjusted under 35 U.S.C. 154(b) by 127 days.

(21) Appl. No.: 10/387,932

(22) Filed: Mar. 13, 2003

(65) Prior Publication Data

US 2003/0177594 A1 Sep. 25, 2003

Related U.S. Application Data

(63) Continuation of application No. 09/673,873, filed as application No. PCT/US99/11035 on May 19, 1999, now Pat. No. 6,601,255.

(30) Foreign Application Priority Data

May 22, 1998 (ZA) ..... 98/4346
Oct. 28, 1998 (ZA) ..... 98/9806
Apr. 23, 1999 (ZA) ..... 99/2896

(51) Int. Cl.
*E04H 4/16* (2006.01)

(52) U.S. Cl. ..... 15/1.7; 15/246; 15/246.5; 210/169

(58) Field of Classification Search ..... 15/1.7, 15/246, 246.5; 210/169, 242.1, 416.2; 4/490
See application file for complete search history.

(56) References Cited

U.S. PATENT DOCUMENTS

| | | | | |
|---|---|---|---|---|
| D176,635 | S | 1/1956 | Shalvoy | |
| 2,751,038 | A | 6/1956 | Acheson | |
| 3,039,122 | A | 6/1962 | Birdsall | |
| 3,132,364 | A * | 5/1964 | Oxley | 15/1.7 |
| 3,676,885 | A * | 7/1972 | Wulc | 15/1.7 |
| 3,689,408 | A | 9/1972 | Edmiston et al. | |
| 3,822,754 | A * | 7/1974 | Henkin et al. | 180/7.1 |
| 3,972,339 | A | 8/1976 | Henkin et al. | |
| D264,797 | S | 6/1982 | Burglin et al. | |
| 4,351,077 | A | 9/1982 | Hofmann | |
| 4,429,429 | A * | 2/1984 | Altschul | 15/50.1 |
| 4,558,479 | A | 12/1985 | Greskovics et al. | |
| 4,589,986 | A * | 5/1986 | Greskovics et al. | 210/483 |
| 4,651,376 | A | 3/1987 | Ford | |

(Continued)

FOREIGN PATENT DOCUMENTS

AU 704603 1/1997

(Continued)

*Primary Examiner*—Richard Crispino
*Assistant Examiner*—Shay Balsis
(74) *Attorney, Agent, or Firm*—Dean W. Russell; Kilpatrick Stockton LLP

(57) ABSTRACT

A push side pool cleaner (1) has a spheroidal overall shape, within this shape two outer segments (9, 10) serve as wheels and a central zone (8) carries a suction passage (33) and a debris collector (32) also located entirely within the overall shape. The wheels are driven directly by water jets (44, 45) without any gears or other transmission. A flow splitter is provided in the cleaner (1) to divide push side water flow between the jets (44, 45) which drive the wheels and jets (43) which provide impulsion to the suction passage (33).

20 Claims, 15 Drawing Sheets

U.S. PATENT DOCUMENTS

| | | | | |
|---|---|---|---|---|
| 4,651,377 | A | 3/1987 | Staples | |
| 4,768,532 | A * | 9/1988 | Johnson | 134/111 |
| D325,452 | S | 4/1992 | Gefter | |
| D325,796 | S | 4/1992 | Kallenbach | |
| 5,172,445 | A | 12/1992 | Chandler | |
| D346,888 | S | 5/1994 | Stone | |
| 5,364,512 | A | 11/1994 | Earl | |
| 5,412,826 | A | 5/1995 | Raubenheimer | |
| 5,450,644 | A | 9/1995 | Berman | |
| 5,546,982 | A | 8/1996 | Clark et al. | |
| D409,341 | S | 5/1999 | Van Etten et al. | |
| 5,933,899 | A * | 8/1999 | Campbell et al. | 15/1.7 |
| 5,961,822 | A | 10/1999 | Polimeni, Jr. | |
| 5,985,156 | A * | 11/1999 | Henkin et al. | 210/744 |
| D418,640 | S | 1/2000 | Veloskey et al. | |
| 6,039,886 | A | 3/2000 | Henkin et al. | |
| D430,960 | S | 9/2000 | van der Meyden et al. | |
| 6,357,478 | B1 | 3/2002 | Campbell et al. | |
| 6,365,039 | B1 | 4/2002 | Henkin et al. | |
| 6,398,878 | B1 | 6/2002 | Henkin et al. | |
| D469,589 | S | 1/2003 | Wichmann et al. | |

FOREIGN PATENT DOCUMENTS

| | | |
|---|---|---|
| EP | 0426365 | 5/1991 |
| EP | 0468876 | 1/1992 |
| WO | WO 97/01689 | 1/1997 |
| WO | WO 97/49504 | 12/1997 |

* cited by examiner 1
2
3
4
5
6
7
8
9
9a
9b
10
10a
10b
11
12
13
14
15
16

POOL CLEANER

CROSS-REFERENCE TO RELATED APPLICATIONS

This application is a continuation of and claims priority to (allowed) U.S. patent application Ser. No. 09/673,873 filed on Feb. 28, 2001, now U.S. Pat. No. 6,601,255, which is the U.S. national phase entry of International Patent Application No. PCT/US99/11035 filed on May 19, 1999, which in turn claims priority to South African Patent Document No. 98/04346 filed on May 22, 1998, South African Patent Document No. 98/09806 filed on Oct. 28, 1998 and South African Patent Document No. 99/02896 filed on Apr. 23, 1999.

FIELD OF THE INVENTION

This invention lies in the field of pool cleaners which are driven by water circulated by a pump. The invention is not necessarily limited to "automatic pool cleaners", depending on what precisely is understood by this term, but the term "automatic pool cleaners" is often used in the context of pool cleaners with which this invention is primarily concerned. Although the words "pool cleaners" will be used for convenience in this specification, they are to be interpreted broadly, as not limited to cleaning of domestic pools, but to include other bodies of water in which a cleaning and/or stirring action is required. The art in this field is divided into two parts, namely suction side cleaners and push side cleaners, referring to the suction and push sides respectively of a pump system which circulates water in the pool. The present invention lies primarily though not exclusively, in the push side part of the art, the term "pressure side cleaners" is also used to refer to the same push side cleaners.

BACKGROUND OF THE INVENTION

Push side pool cleaners are distinguished from suction side cleaners, for various reasons known in the art; an example of a push side cleaner is described in South African patent 85/0648, granted to Alopex Industries, marketed as the "POLARIS" (trademark).

Whereas suction side cleaners have an effective wiping or rubbing action on the pool surfaces, this is a shortcoming with push side pool cleaners of the present art which run on wheels with a venturi passage passing over the pool surfaces with a clearance between the mouth of the venturi and the pool surface.

Again, whereas suction side pool cleaners have few moving parts, the cleaner moving over the pool surfaces under impulsion of intermittent water flow caused by an oscillating tongue, or a suction tube whose wall collapses intermittently, for example, certain push side pool cleaners of the art have the disadvantage that they are moved by means of a water turbine driving the wheels through a drive train consisting of many gears and shafts.

Also, whereas suction side cleaners remove very small particles from the pool because the particles picked up are passed through the main pool filter, push side pool cleaners of the art do not pass particles through the main pool filter, but through a bag filter attached to the cleaner; dust size particles pass the apertures of bag type filters to re-enter the pool water, so that these cleaners must rely on stirring up these dust size particles so that they remain sufficiently in suspension to be drawn into the pool weir and thence to the main pool filter.

Whereas suction side cleaners are "add on" products, which the owner of an existing pool and filtering system can add on without technical assistance, most push side cleaners of the present art are initially set up by a technically capable person, where they are connected to a booster pump in the main pool filter circulation system, or into a dedicated water circulation system. Hence push side pool cleaners of the art tend to be sold via contractors who are building a pool and circulation system.

Although push side pool cleaners do have potential for less interference with the desirable randomness of movement over the pool surfaces, due to a smaller diameter hose being acceptable, than suction side cleaners, much of this potential advantage is lost by the wheeled drive of these cleaners of the push side cleaner art which tend to provide straight line travel. The POLARIS cleaner has three wheels asymmetrically arranged to try to reduce this effect, for example. There is a continuing need in the art for better randomness of movement of the cleaner over the pool surfaces, leading to better cleaning.

The push side water flow is given a bypass valve at the pool side allowing water flow to the cleaner to be adjusted by increasing or decreasing the bypass, so as to get an acceptable speed of movement of the cleaner over the pool surfaces. A disadvantage of this arrangement of the art is that the energy of the bypassed flow is discarded.

Finally, all present pool cleaners have limitations as to the shallowness at which they will operate and as to their ability to negotiate formations like stairs in pools without becoming stuck in one position. It is desirable that pool cleaners work in shallower regions and thus negotiate formations like stairs better.

Thus there exists a need to address these limitations and problems in push side cleaners of the art at least to some extent.

SUMMARY OF THE INVENTION

The present invention provides a push side cleaner which is generally spherical or prolate or otherwise spheroidal in the shape of its outer surfaces (or otherwise expressed, the cleaner outer surfaces conform with a conceptual outer envelope of spherical or prolate spheroidal shape). The invention can also be implemented in an outer shape which conforms to two truncated cones both tapering outwardly from a central region of the cleaner, for convenience the term "bi-conical" will be used in the description and claims to briefly refer to this shape. The invention can also be implemented in a cylindrical shape.

These shapes can comprehensively be described as a family of solids of revolution and other similar shapes, lying between the spherical/spheroidal, conical and cylindrical are also accommodated within the scope of the invention. In this description the term spheroidal only will henceforward be used for convenience, comprehending within its scope also the meaning indicated in the preceding sentence.

A central zone of the spheroidal shape bounded by two segments of the spheroid on each side will form the total outer shape. The central zone will have a push side hose connected to it and the two segments will be rotatively driven on either side to provide impulsion to the cleaner for moving it over the pool surfaces to be cleaned. The central zone will have a clearance from the pool surfaces and will accommodate a venturi or other suction passage for drawing in debris from the pool surfaces.

The two segments may be independently driven, or there may be advantage in linking them by a shaft so that they rotate being fixed relative to each other.

Thus a feature of the cleaner of this invention is that the spheroidal surfaces of the two segments will provide impulsion to move the cleaner over the pool surface, wherever these surfaces engage the pool surfaces and in whatever orientation the cleaner happens to be. In this sense, then, the cleaner of this invention is capable of providing impulsion to the cleaner in three dimensions; by contrast, the pool cleaners of art, both of the push side and of the suction side types, are confined to impulsion only in two dimensions. The cleaners of art must remain oriented with their wheels or foot against the pool surfaces, if they capsize, they are, like a conventional vehicle, unable to move, until righted. By contrast the cleaner of this invention can turn any way round relative to the pool surfaces, be they horizontal or vertical, and still provide impulsion. Furthermore, this three dimensional character of the motivation capability of the cleaner of this invention provides a dramatic enhancement of the ability to achieve more random movement over pool surfaces. The spheroidal surface interacts with the pool surfaces with an additional dimension of randomness i.e. the third dimension in addition to the two dimensions of the pool surface. The cleaner is in fact more unstable than one on wheels or a foot (a foot is used in suction side cleaners) and gives better randomness. For example, when the cleaner engages a wall of the pool surfaces, it has the capacity for the axis on which the two segments were rotating over the pool floor, to swing with three dimensions of freedom to a new orientation, giving enhanced randomness of movement. In a practical embodiment which has been subjected to extensive testing, the three dimensional movement can be described to occur with respect to an axis of the push side hose connection: these are, firstly around the axis, secondly swinging the axis to left and right and thirdly swinging the axis up and down. The randomness of movement is known in the art to be important, in order to result in cleaning of all of the surface to be cleaned, over a period of time, non-random movements leave "dead" spots which remain uncleaned.

Portions of the spheroidal surfaces of the segments may have brush like formations, e.g. bristles, on them, to give a brushing effect.

Preferably the pool cleaner having the features of this invention is made with a specific gravity closer to 1 than is appropriate in cleaners of the art. This is made possible by the three dimensional character of the movement of the cleaner of this invention.

The effective or net force acting on the cleaner, when the cleaner is under water, may be made to pass through a point located on the opposite side of the axis of rotation of the cleaner as a mouth of the suction passage. This may be done with floats, e.g. sealed volumes containing air) located on the same side of the axis of rotation of the cleaner as the mouth. The cleaner may still have a centre of gravity when outside water which centre is on the same side of the axis as the mouth. However, when submerged, the buoyancy of the floats reverses the position of the net force acting on the cleaner to the opposite side of the axis as the mouth. The effective or net force acting on the cleaner when submerged can be assessed by constructing the vector sum of the gravitational forces and the buoyancy forces.

This counter intuitive approach results in a less stable device under water, which is tolerable by virtue of the spheroidal shape of the cleaner of this invention. The lower stability results in more random movement over the pool surface which in turn gives the advantage, as mentioned, of less tendency for the cleaner to repeatedly miss some areas, leaving them uncleaned.

A feature of this invention, whether the floats are used, or not, is that the centre of gravity is made closer to the axis of rotation of the cleaner than is appropriate in cleaners of conventional design. This feature again reduces stability and as a result brings the beneficial advantage of greater randomness than is achieved in conventional cleaners. This is possible simply for the reason already stated, that spheroidal shape gives the advantage that the cleaner can not "capsize" into a position in which it can no longer move, like a conventional vehicle.

The degree of buoyancy of the hose may be selected, for example, to achieve a desirable balance between a tendency to work well on the bottom surfaces of the pool, on the one hand, and also on the wall surfaces, on the other.

The cleaner of this invention may be given a jet which impels the cleaner against the pool surfaces with a mouth of the suction passage in proximity to the pool surfaces, achievable both on upright as well as horizontal parts of the pool surfaces.

Preferably the passage is given a direction, at least near the mouth of the passage, which has a tangential component as well as a radial component. In other words, the venturi passage, at least near its mouth, is preferably not normal (at right angles) to the spheroidal outer surfaces of the cleaner. The passage is oriented so that the mouth is directed in the direction in which the cleaner moves. This gives a degree of scooping action, helpful to lifting debris from the pool surfaces. Jets which provide the suction action in the suction passage, given this tangential component of direction, also assists in the forward impulsion of the cleaner, by jet reaction forces.

This invention further provides a pool cleaner which is driven by direct impulsion of water jets from the push side supply onto vanes on wheels of the cleaner. No drive train is provided or required, there are no gears or drive shafts transmitting a drive to wheels. The spheroidal shaped cleaner, as described above, provides the wheels in the form of the outer segments of the spheroidal shape.

Preferably, this drive feature is provided in the cleaner having a spheroidal outer shape, as described above. The vanes are provided at an inner edge of each segment, with the water jets issuing from nozzle formations provided on the central zone. Low energy losses giving more efficient use of the water energy can be achieved by the judicious application of this aspect of the invention. An advantage that is achievable as a result is that more of the total water energy available from the push side supply can be devoted to the suction function while still leaving sufficient for impulsion of the cleaner. Wearing parts in a drive train are eliminated.

A further feature of the invention, which is preferably implemented with the features described above, is the location of a debris collector inside the spheroidal shape of the cleaner. Conveniently, the debris collector is confined to within the central zone, because this makes it simple to lift the debris collector out of the cleaner to empty it, from time to time. Thus the suction passage leads to the debris collector which is located in the central zone. The debris collector can includes a sump region and must include sieve or screen surfaces to allow the water to exit the collector and retain the debris. The suction passage is therefore preferably curved, leading from the mouth which is oriented with a tangential component of direction, to the collector.

A still further feature of the invention relates to the splitting or division of the water which is supplied to the cleaner via the push side hose between the jets which provide the suction action within the suction passage and the jets which provide the direct impulsion onto the vanes on the wheels. In accordance with the invention, a water flow splitter is provided which comprises two passages which have adjacent entrance mouths, a movable occluding element which is movable to selectable position settings in which one entrance mouth is occluded more or less than the other entrance mouth. The preferred structure for the adjacent entrance mouths is a circular tube with a diametral dividing wall and for the occluding element a cylindrical cup shaped element rotatable in the tube with a bottom of the cup located against the diametral dividing wall and the bottom having a semi-circular opening and movable by rotation of the cup shaped element. The occluding element can have markings on it to indicate various optional settings which provide different splits between the driving jets and suction generating jets. There may be grooves and ridges on the occluding element and the adjacent mouths to retain selected settings and the manufacturer or supplier may provide a selected setting to the user.

These splitting arrangements still allow for the water supplied by the push side hose to the cleaner to be provided to a third use, namely the jet which issues: external to the cleaner to provide an impulsive force assisting the forward motivation of the cleaner and/or the attachment to a surface to be cleaned.

A beneficial effect of a pool cleaner designed according to this invention, is that a positive pressure is created inside the spheroidal cleaner other than in the suction passage, so that debris which might otherwise accumulate in unwanted spaces does not do so.

BRIEF DESCRIPTION OF THE DRAWINGS

The invention will more fully described by reference to a non-limiting example shown in the drawings.

In the drawings:—

DESCRIPTION OF THE PREFERRED EMBODIMENTS

Figures 1, 2, 3, 4, 4A, 4B:
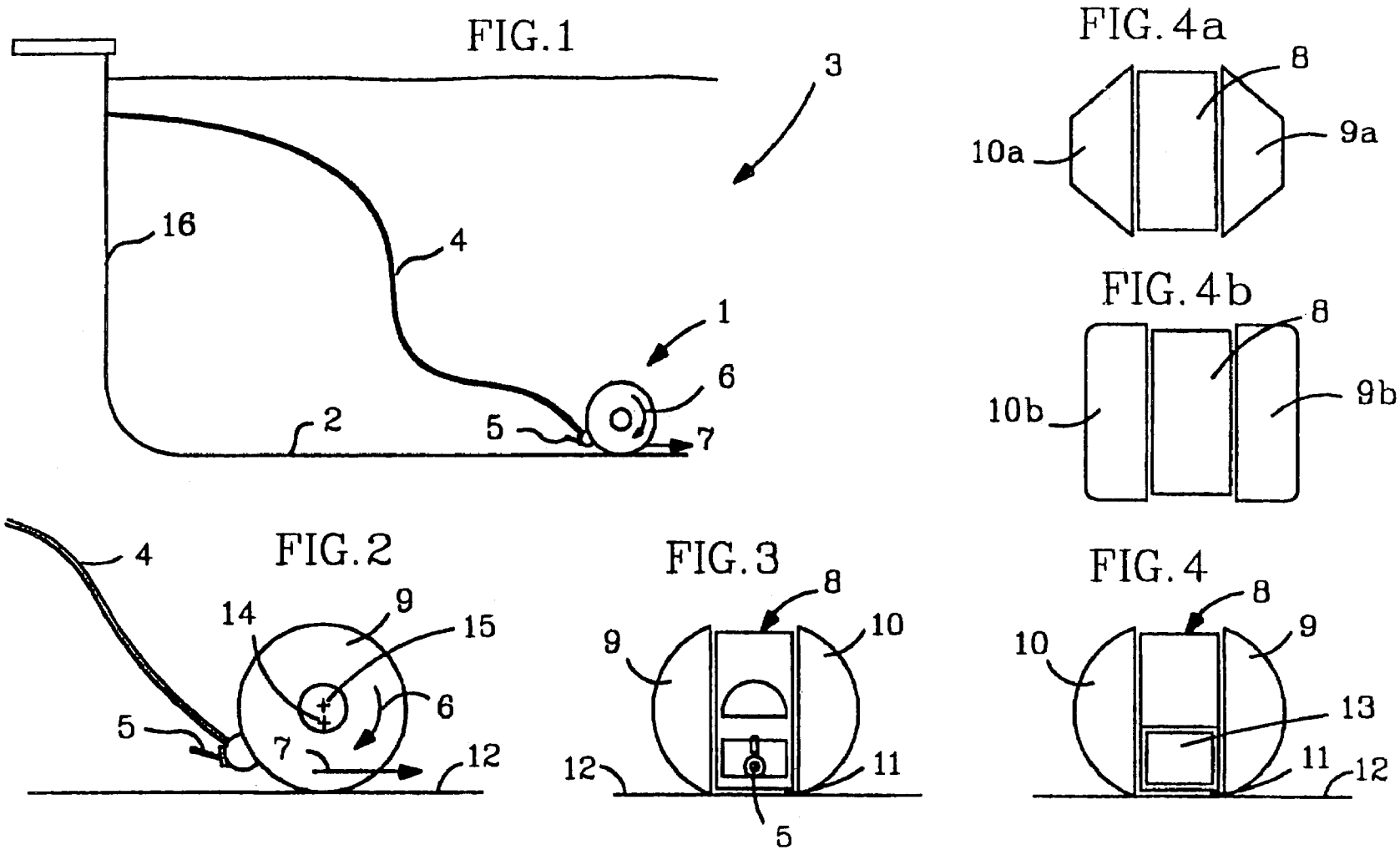
FIG. 1 is a schematic view showing a pool cleaner of this invention in a pool.
FIG. 2 is a side elevation of a pool cleaner of this invention.
FIG. 3 is a rear elevation of a pool cleaner.
FIG. 4 is a front elevation of the pool cleaner.
FIG. 4*a* is a front elevation of an alternative shape for the cleaner.
FIG. 4*b* is a front elevation of another alternative shape for the cleaner.
Figure 17:
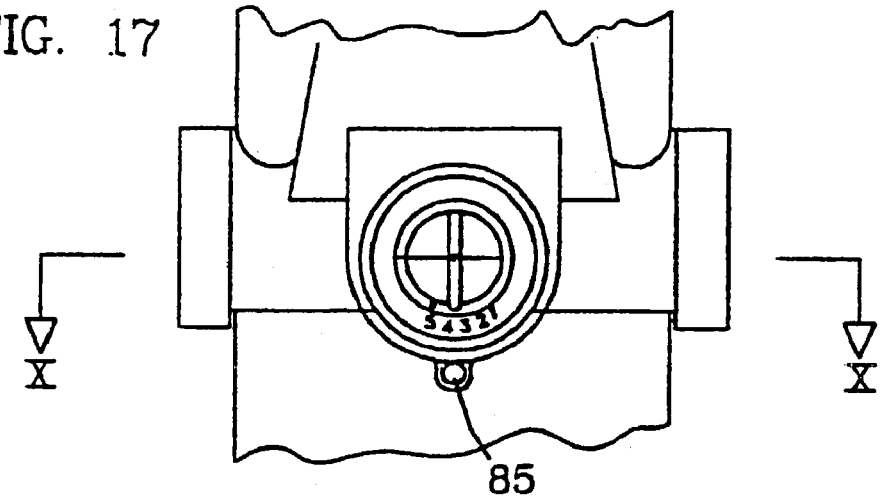
FIG. 17 is a rear elevation of a flow splitter for the cleaner.

FIG. 1 schematically shows a push side cleaner 1 located on a bottom surface 2 of a pool 3. The pool cleaner 1 has a hose 4 connected to the push side of a water circulation system which circulates and filters water for the pool. The pool cleaner 1 has a nozzle 5 which jets water rearwardly of the pool cleaner so as to assist in propelling it along the pool surface and the nozzle is mounted in a ball joint so that it can be angled, or it can be manufactured in a fixed angle position, as shown by reference numeral 85 in FIG. 17. The angle of the nozzle may be made suitable also to press the pool cleaner to some extent onto the surface of the pool along which it is moving. The pool cleaner moves by rotation of the outer segments of the cleaner in the direction indicated by the arrow 6 so that the pool cleaner moves along the pool surface in the direction indicated by the arrow 7.

As shown in FIGS. 2, 3 and 4 the push side pool cleaner is generally spheroidal in shape of its outer surfaces. The pool cleaner comprises a central zone 8 bounded by two segments 9 and 10. The central zone 8 has the push type hose 4 connected to it and the two segments 9 and 10 are rotatively driven as indicated again by the arrow 6. The central zone 8 has a clearance 11 from a pool surface 12 on which the cleaner moves. The mouth has added to it a movable lip 81 (FIG. 23) which is hinged to the mouth and has a plastic formation 83 which acts as a spring to urge the lip downwards to tend to bear against the surface to be cleaned, as the cleaner moves over the surface. The central zone 8 also accommodates a venturi 13 which has its mouth shown in FIG. 4 directed forwardly in relation to the direction of motion 7 of the cleaner in use. The two segments in this example are independently driven, as will be described below. The center of gravity is located at a position 14 of the cleaner thus below the axis of rotation 15 in the orientation that the cleaner will normally assume along a bottom surface of the pool. Because of the lightness of the cleaner and because of the spherical surfaces which can provide the impulsion for the cleaner, however, it is relatively unstable, can swing and rotate and the axis 15 oscillate in three dimensions so as to provide a high degree of randomness of the movement over the pool surfaces. This would occur particularly, for example, where the cleaner, moving over the bottom surface 2 of the pool would contact a wall 16 of the pool. (FIG. 1). Because of the jet 5 and the specific gravity close to 1 the pool cleaner will climb up the wall 16 but also in many instances one segment may lose contact while the other retains contact and this will result in a rotation of the pool cleaner about an axis approximating to the axis of the hose 4 where it is connected to the cleaner, for example. This and many other relatively acrobatic gyrations of the cleaner are possible. The hose 4 and/or its connection to the cleaner has a rotational coupling to allow this freedom. If the cleaner lands on the pool bottom surface upside down or some other orientation this does not matter because of its spherical shape and that all of the surfaces which can touch the pool surfaces are rotating so that the cleaner undergoes twisting and turning in a highly random manner.

FIG. 4*a* shows another shape for the cleaner which is two truncated conical segments 9*a* and 10*a*, tapering outwardly.

Figure 5:
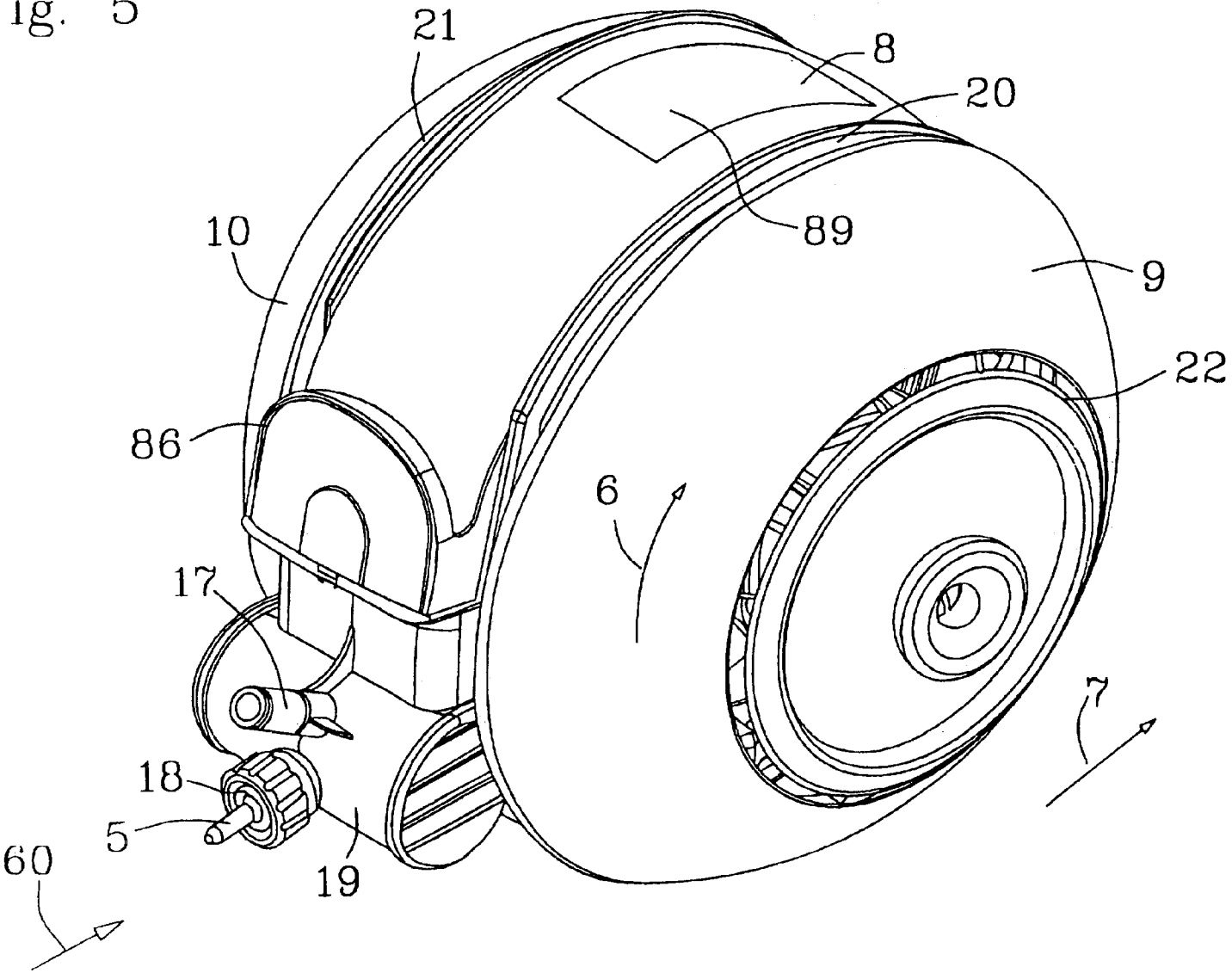
FIG. 5 is an isometric view of the cleaner.

FIG. 4*b* shows yet another shape for the cleaner in which the two segments 9*b* and 10*b* are cylindrical Turning to FIG. 5 the main features of the pool cleaner in its exterior surfaces can be seen and the same reference numerals as have been used in the preceding figures are shown in FIG. 5. In addition the nipple 17 is seen to which is connected the hose 4. The jet 5 in a ball joint connection is seen in more detail with the ball 18 visible. Furthermore a manifold 19 is seen which serves to distribute the water supplied at the connection 17 from the hose 4. The manifold's purpose is to distribute the water on the one hand to two jets inside the cleaner (which will be described below) each of which drives one of the two segments 9 and 10 and to distribute water to a jet or jets in the suction passage. The water jets in the suction passage have an entrainment and/or venturi effect which results in the suction passage drawing water in from the general body of water of the pool just ahead of the mouth of the suction passage and also to draw in debris as the pool cleaner moves forward. As can be seen in FIG. 4 this mouth is directed in the direction in which the pool cleaner moves. The view of FIG. 5 also shows a gap 20 between the segment 9 and central zone 8 on the one hand and 21 between the segment 10 and the central zone 8 on the other hand. The view also shows a slotted circular hole 22 in the segment 9 and a similar circular slotted hole (not seen) is provided in the segment 10. These openings allow water which has been drawn into the suction tube, has passed into the debris collector and then moves out through the sieve walls of the debris collector, to exit from the pool cleaner as a whole. This aspect of the cleaner design of this invention results in the interior of the cleaner, apart from the suction passage, being under positive pressure, i.e. slightly higher pressure than the ambient water. This is advantageous, of course, in that there will not be tendency for debris to be sucked into interior regions of the cleaner, other than the suction tube. The holes 22 also allow escape of air from the cleaner should air enter it, e.g. due to the cleaner breaching the water surface.

Figure 6:
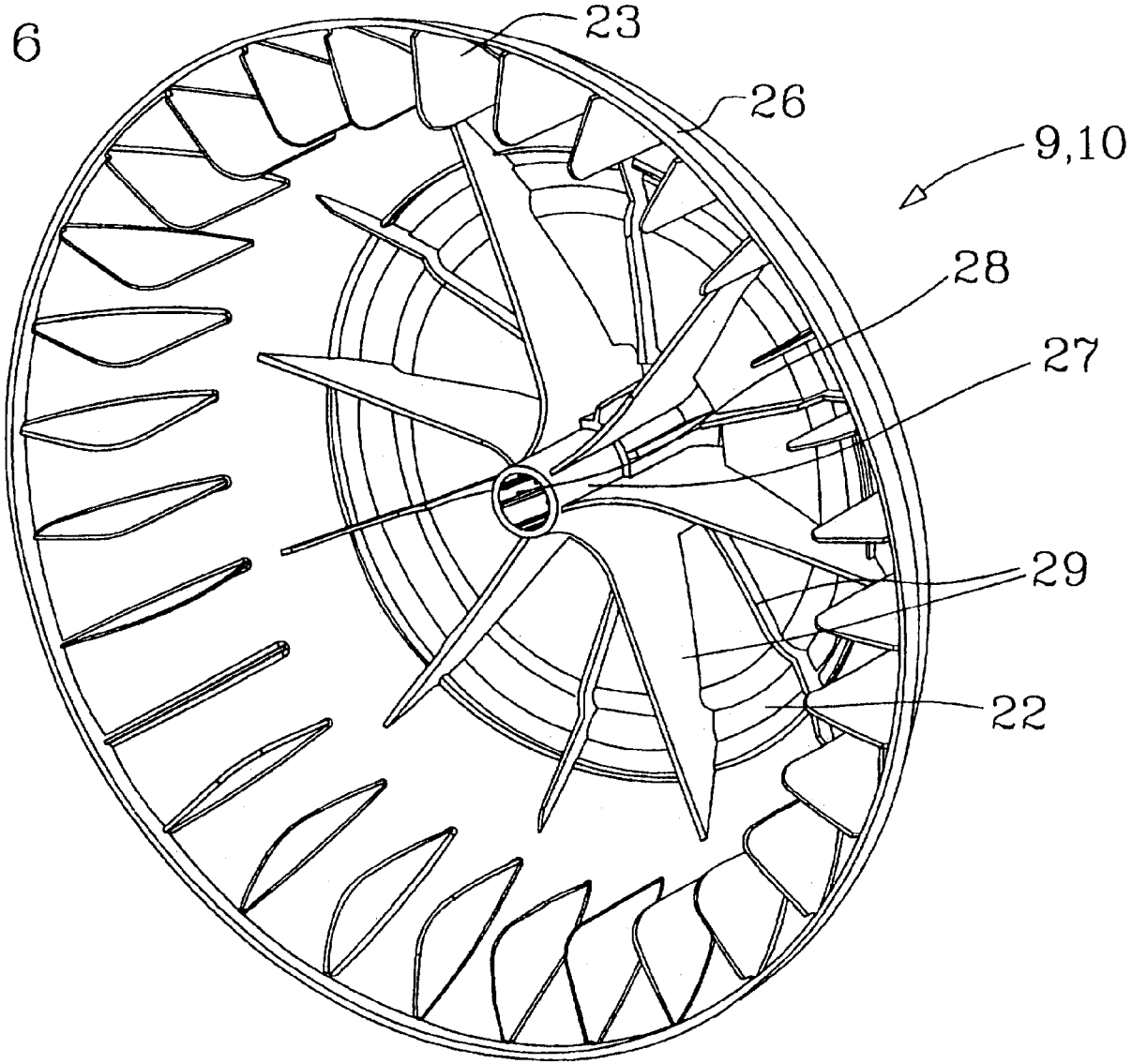
FIG. 6 is an isometric view of the inner surfaces of a segment of the cleaner.
Figure 7:
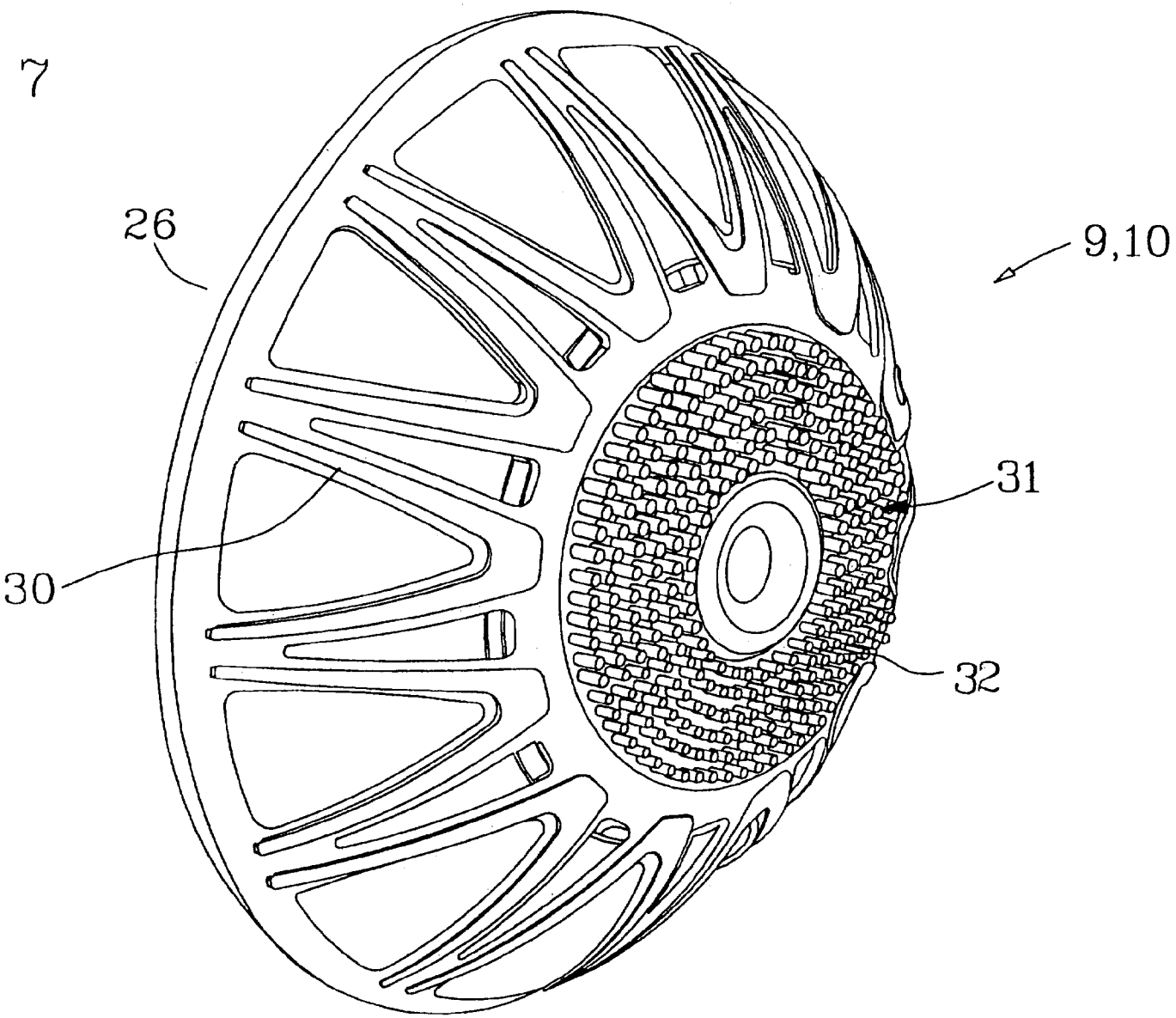
FIG. 7 is an oblique view of the outer surfaces of a segment of the cleaner.

FIGS. 6 and 7 show a segment of the pool cleaner, the segments are identical with each other on each side. FIG. 6 shows the interior of the segment and the important formations inside the segment include the vanes 23 arranged on the interior surface of the segment near the edge 26 of the segment. It is on to these vanes that a jet of water impinges in order to drive the segment rotatively and which provides the motivation for the pool cleaner to be driven forward. The view also shows the important feature of the bush 27 having in it splines 28 into which a shaft (to be described below) is inserted. This establishes the axis of rotation of the segment in use.

The view also shows the slotted aperture 22 and a plurality of flanges 29 provided for structural purposes. Prototype trials have shown that the splines can be omitted and instead a fairly firm friction fit used between shaft and wheel. The friction fit allows the connection to give way if an excessive torque is applied so that the shaft is not broken The view of FIG. 7 shows the outer surfaces of a typical segment 9 or 10. The outer surfaces have a highly flexible polymer applied in a pattern 30 which is designed to give improved traction of the segment against surfaces of the pool and it has aesthetic aspects as well. However, a region 31 of the segment near its axis of rotation has bristles 32 designed so as to provide a brushing action when this region 31 engages surfaces of the pool. The segment itself would be, for example, moulded from a suitable other polymeric material, e.g. an engineering plastic.

Figure 8:
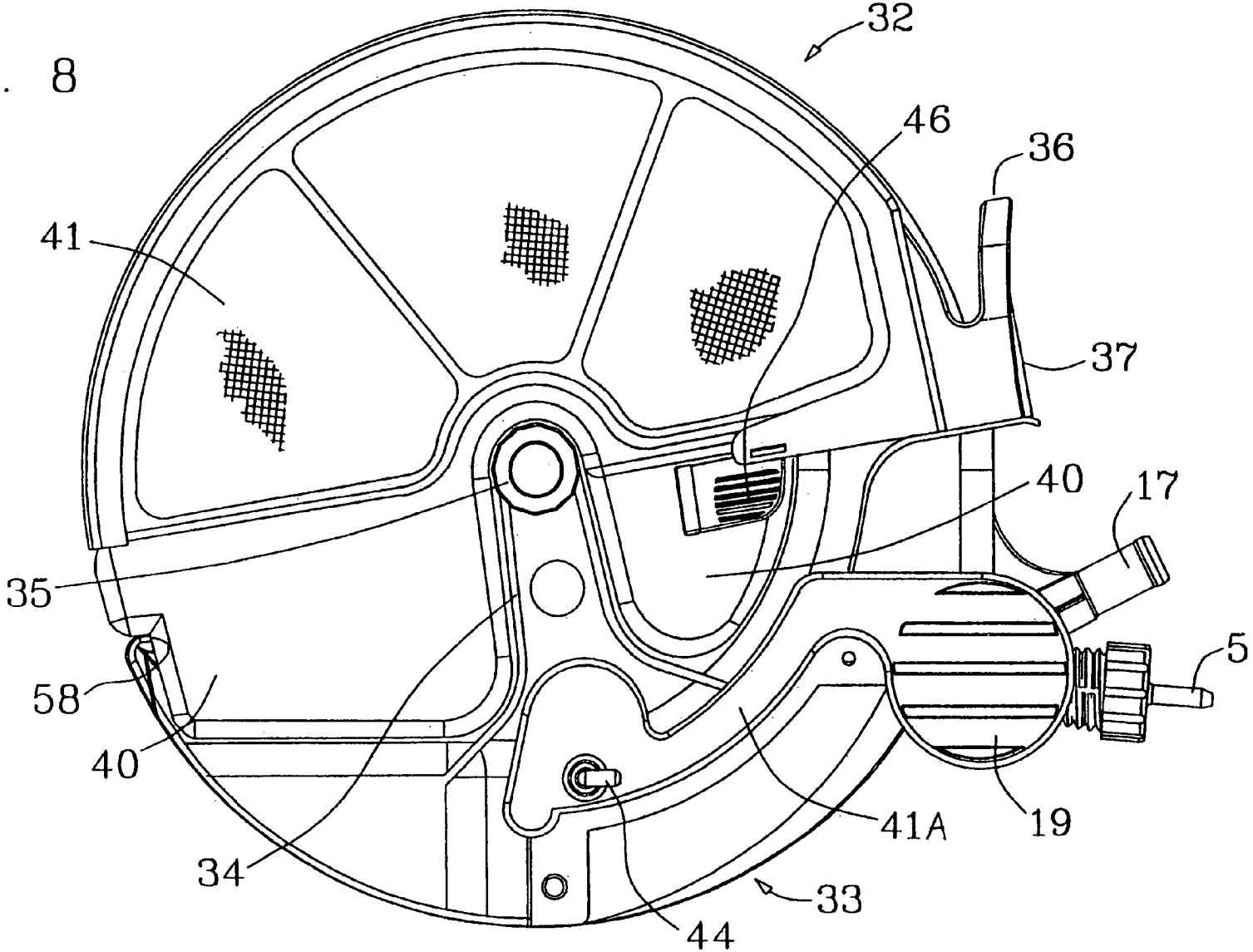
FIG. 8 is a side view of the cleaner with the near side segment removed to show a side view of the central zone.
Figure 9:
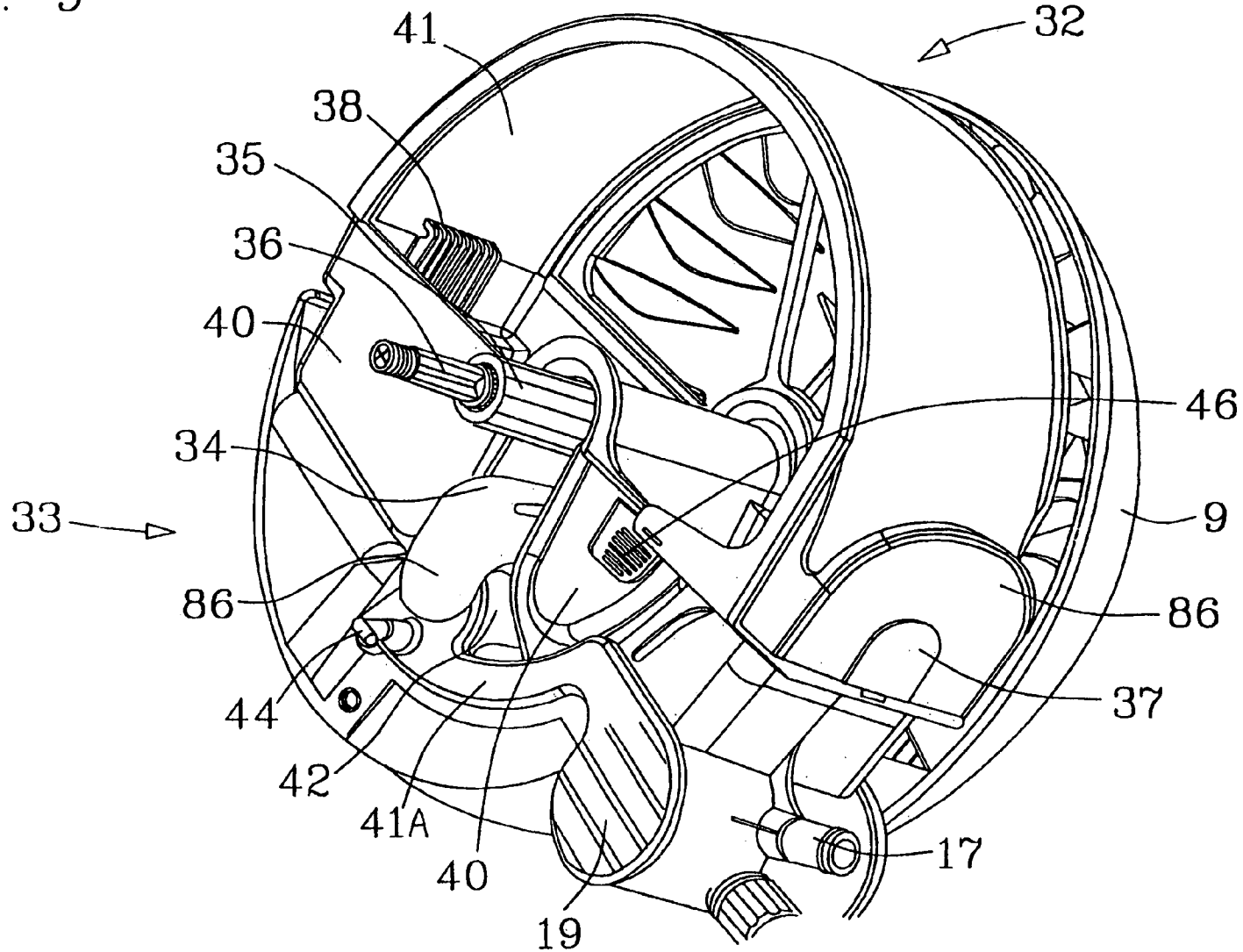
FIG. 9 is an oblique view of the cleaner with the near side segment removed to show a central zone and parts of the inner surface of the far side segment.

The view of FIG. 8 allows a side view of the central zone of the cleaner since the near side segment has been removed. Reference is at the same time made to FIG. 9 which is an oblique view with the front segment removed and to FIG. 10 which is an oblique view with both segments removed.

These figures show that the central zone of the pool cleaner comprises two major components, a debris collector and a suction passage. The debris collector is indicated generally by the arrow 32 and the suction passage generally by the arrow 33, the debris collector is shown also in the views of FIGS. 14 and 15 and the suction passage is shown also in the views of FIGS. 11, 12 and 13 and more detailed description will be given with reference to these figures below. The suction passage includes integrally a support structure 34 which supports a housing 35 which carries bearings 56 for a shaft 36 (FIG. 9) which projects at both ends from the housing 35 so as to be inserted into the splined holes of the outer segments of the pool cleaner. This allows for rotation of the two segments with respect to the central zone on an axis lying along the centre line of the shaft 36 and in this example the two segments must necessarily rotate at the same speed as they are both splined onto the same shaft. This splines may be replaced by a friction fit to allow slipping should large forces arise. As supplied to the customer the two segments will be fixed to the shaft 36 and hence will not usually be removable from the suction passage 33 and structure 34 which carries the housing 35 in which the shaft is journalled. However, the debris collector 32 can be lifted out from the pool cleaner by means of the handle 86 being grasped, the tab 37 being pushed so as to disconnect a latch on the suction passage structure. At the other end of the debris collector, formation 50 of the suction passage structure engaging detent 58 of the debris collector structure provides for a hinging action initially after which the debris collector comes free from the suction passage structure and can be lifted out of the pool cleaner for cleaning out of the collected debris. The suction passage 13 presents its mouth 39 (see FIG. 10) on the forward side of the pool cleaner relative to its direction of advance 7 and water and debris ingested at the mouth 39 passes along the curved suction passage 13 into the debris collector 32. The debris collector consists of a sump 40, which is partitioned by the necessity of the bush 35, and a portion 41 having gauze which is provided on both sides for escape of water but retention of debris inside the debris collector, (the gauze is not shown in FIG. 9).

Figure 10:
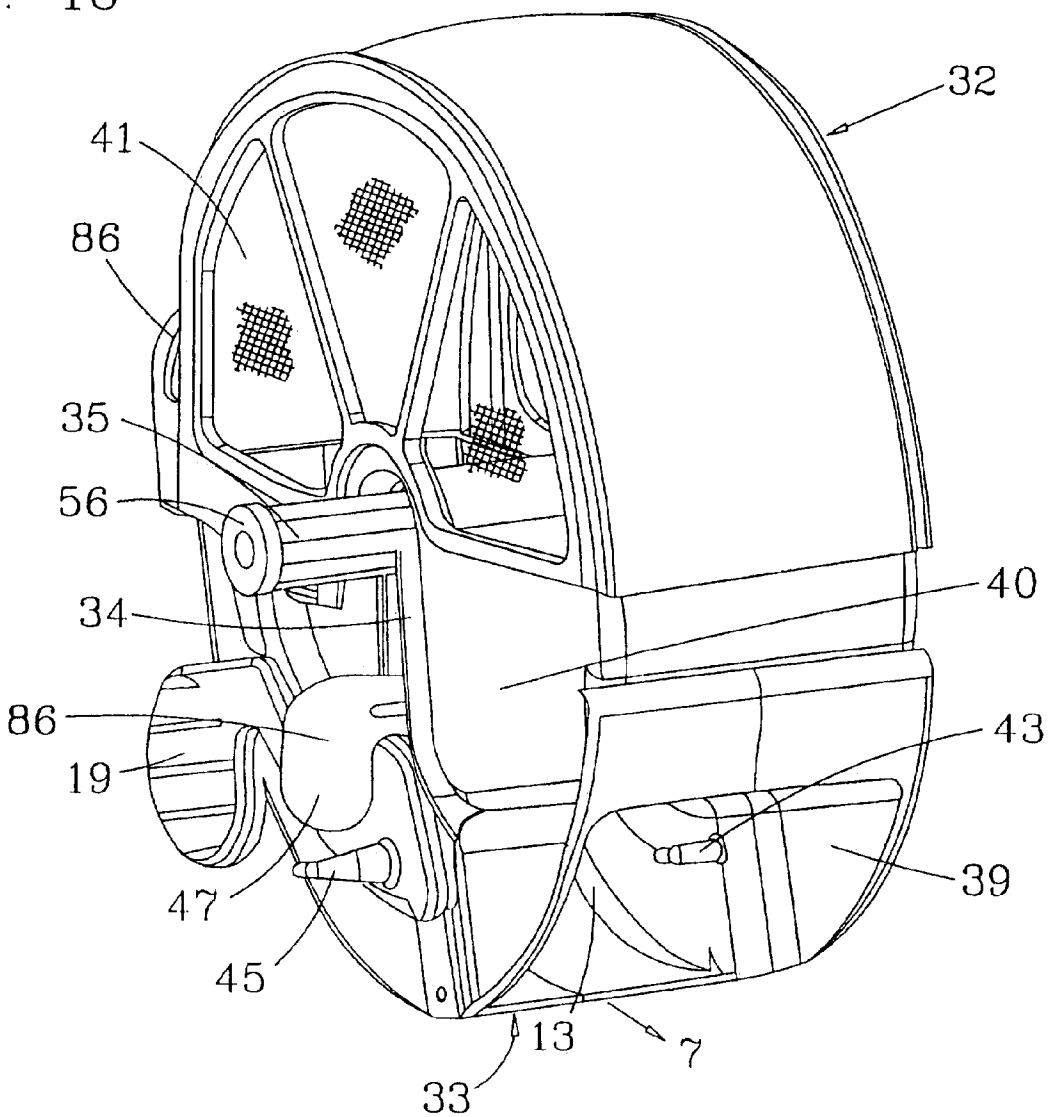
FIG. 10 is an oblique view to show only the central zone of the cleaner.

The manifold 19 extends across the width of the central zone so that water entering it from the connector 17 can enter a passage 41A on the near side of the suction passage structure which is seen in these views and also a similar passage on the other side of the structure which is not visible. The passage 41A connected to a passage shown in the structure 42 (FIG. 9) which carries this water also to the other side of the structure and applies thus water equally to two nozzles which are located inside the suction passage 13. One of these nozzles, nozzle 43 can be seen in the view of FIG. 10 and a similar nozzle on the other side of the inner surfaces of the suction passage 13 is similarly supplied with water. These two nozzles direct water jets in a suction passage 13 and they entrain surrounding water and draw it into the mouth 39 and along the passage 13 into the debris collector as well as then entraining debris from the pool surfaces. The passage 47 similar to the passage 41A on the other side of the structure similarly leads to a connecting passage (not seen) which brings the water equally to both sides and thence to two nozzles on the outside of the structure each of which directs a jet on to the mains of the outer segment so as to drive these rotatively. In these views the outer nozzle 44 is visible in FIGS. 8 and 9 and a similar nozzle 45 is provided on the other side (FIG. 10). Thus the nozzle 44 drives the outer segment which has been removed in these views and the other similar outer nozzle drives the segment 9 which is visible, for example, in the view of FIG. 9.

This manner of directing the water flow allows for a structure to be provided inside the manifold 19 which can be used to adjust the division of water between the two inner nozzles which direct their jets into the suction passage 13 on the one hand and the two outer nozzles which drive the outer segments which serve as wheels on the other hand. This structure is not shown but can comprise some convenient partitioning or metering structure such as, for example, are known in other arts such as mixing taps and the like. The sieve part 41 of the debris collector is clipped on to the sump part 40 by the action of a clip which can be released by pressing a tab 46.

Figure 11:
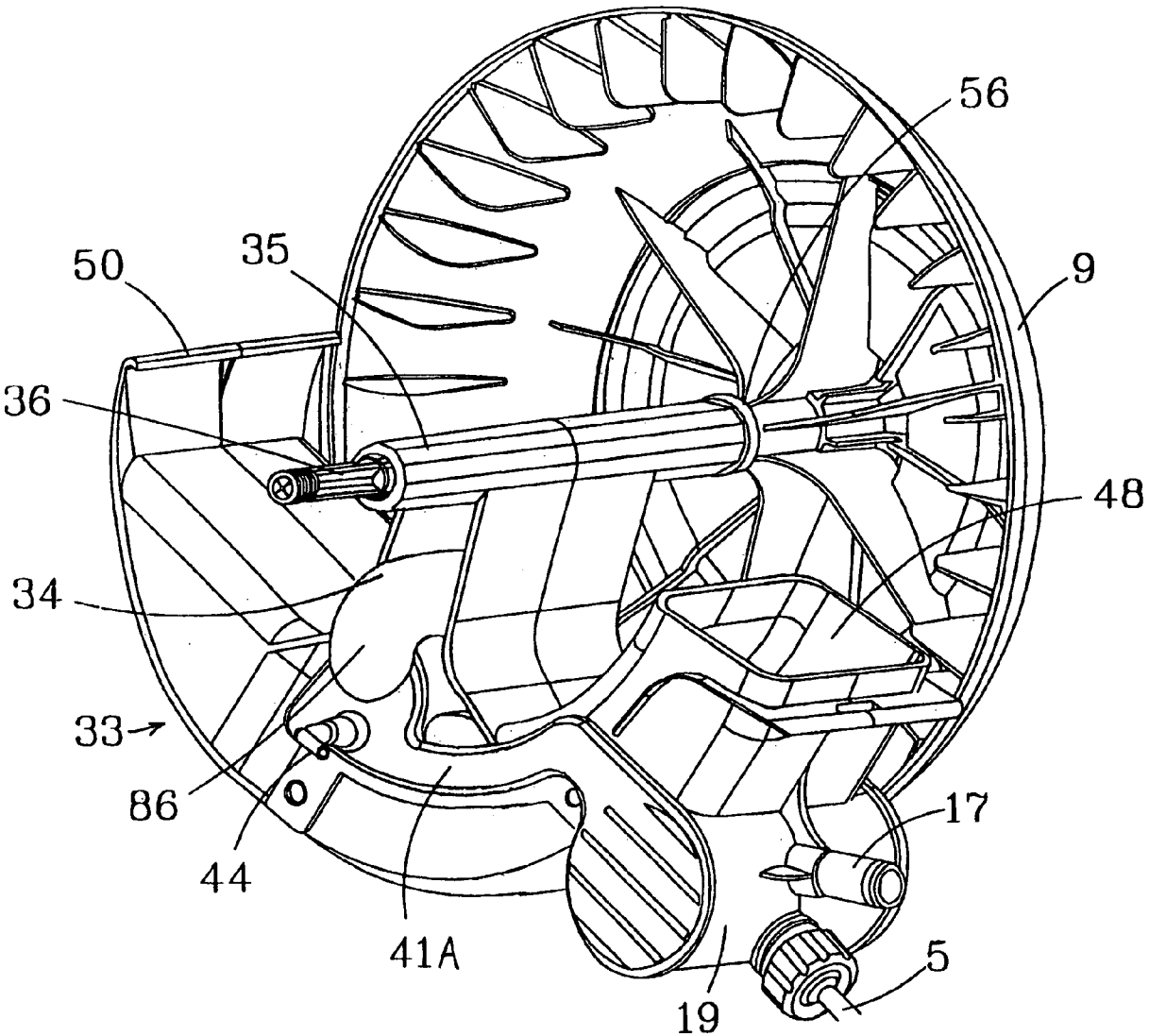
FIG. 11 is an oblique view to show the suction passage of the central zone of the cleaner and the far side segment.
Figure 12:
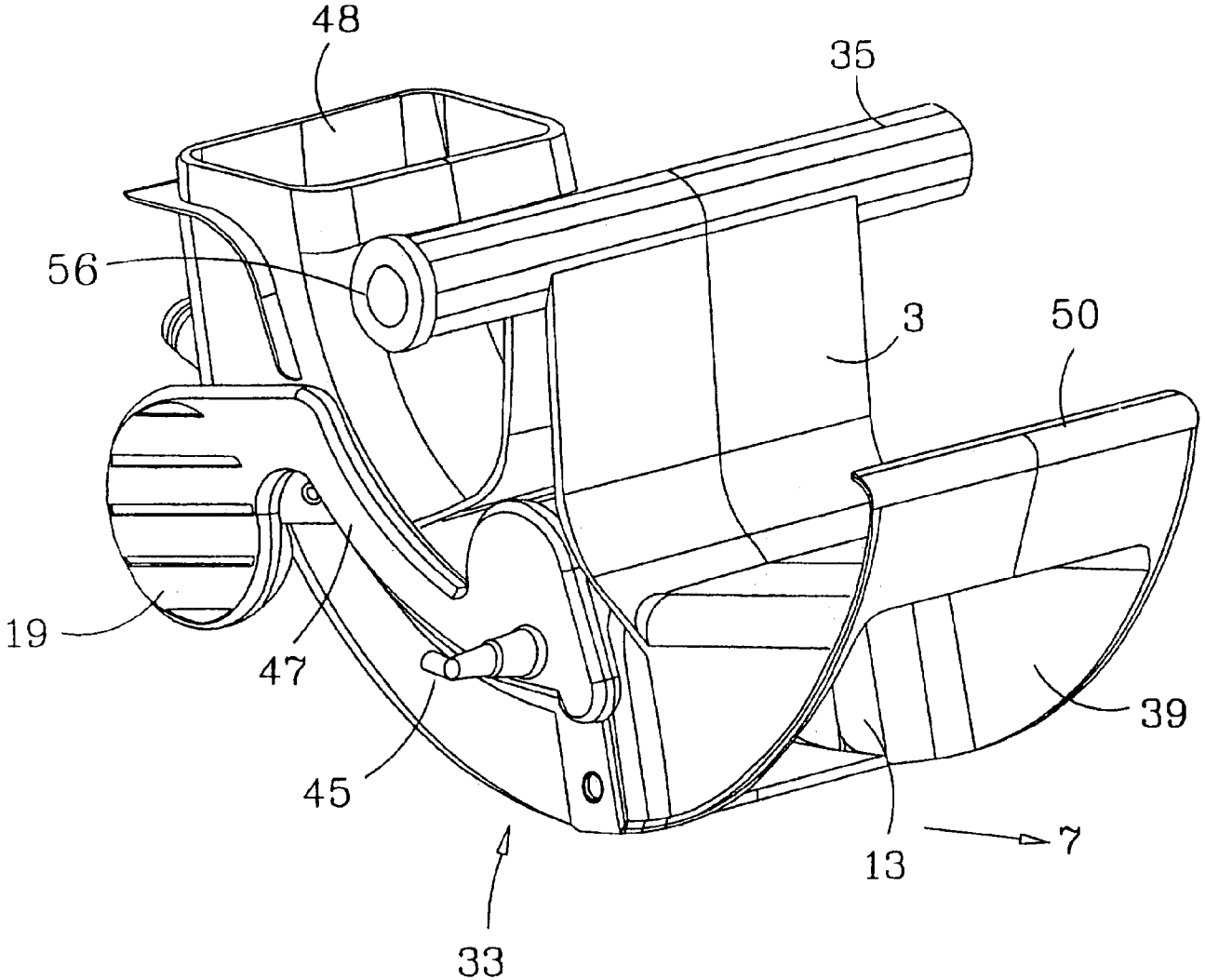
FIG. 12 is an oblique view of the suction passage of the cleaner.
Figure 13:
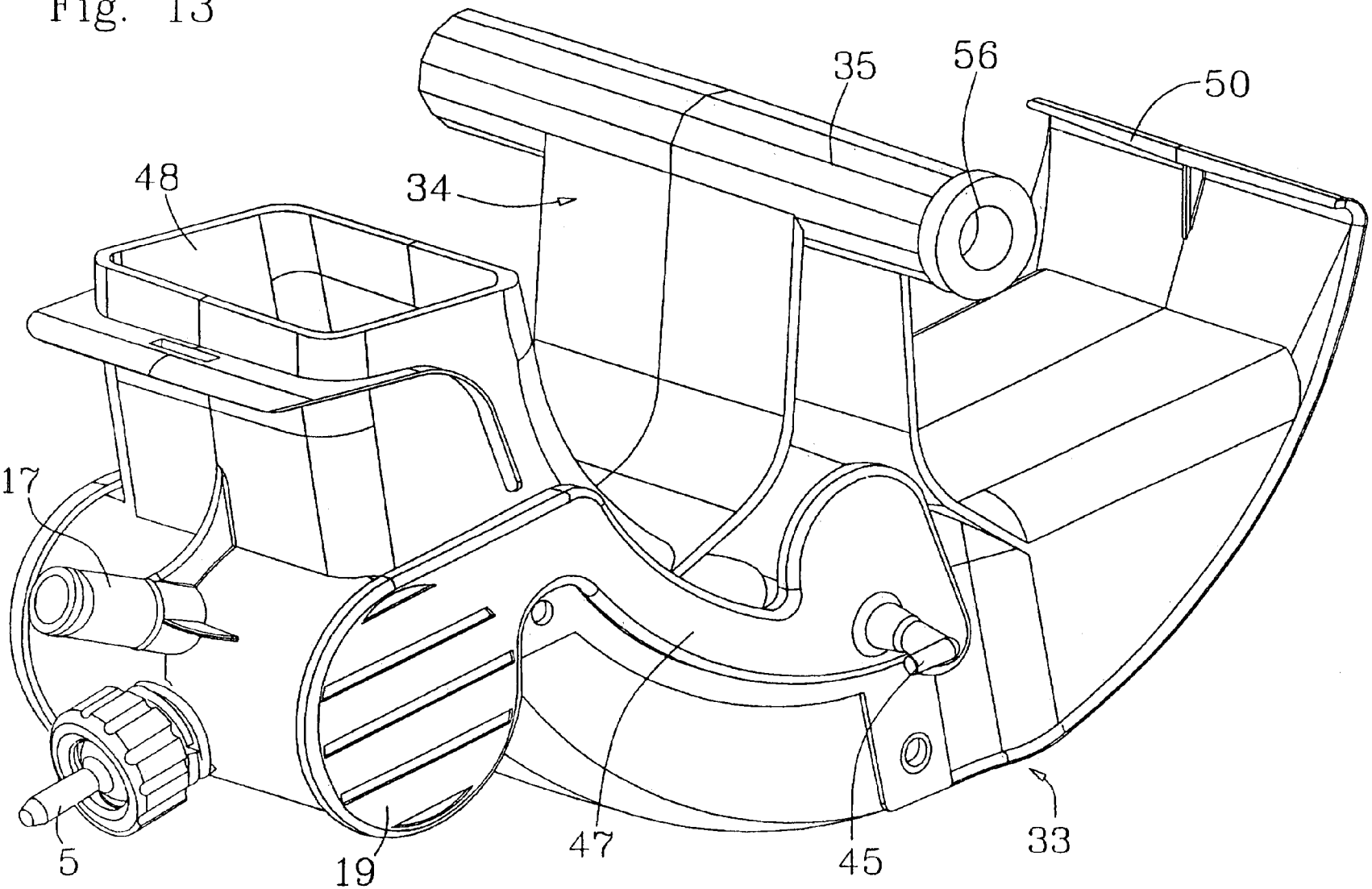
FIG. 13 is an oblique view from another angle of the suction cleaner of the central zone.

Moving on to FIGS. 11, 12 and 13 the suction passage 33 of the debris collector is shown more effectively in these views. In FIG. 11 it can be seen how the sump part 33 has the structure 34 integrally moulded with it supporting the housing 35 in which the shaft 36 is journalled and the far side outer segment 9 is seen on the shaft. As mentioned the assembly of this sump unit shaft and both outer segments is normally not disassembled by the user.

The views 11, 12 and 13 show rather well the curved suction passage 13 with the open mouth 39 of this passage. The views of FIG. 12 and 13 also show the second of the outer jets, the jet 45 which is a mirror image of the jet 44 seen in previous views. The views also show the passage 47 which is a mirror image of the passage 41A. The internal connection of these two passages are, however, as mentioned such that the passage 41A feeds both internal jets and the passage 47 feeds both external jets. The suction passage 13 with its mouth 39 directed forwardly relative to the direction of movement 7 in use curves upwardly to an exit 48 of the suction passage 13. It is this exit 48 which discharges water and debris into the debris collector as has been described previously.

Figure 14:
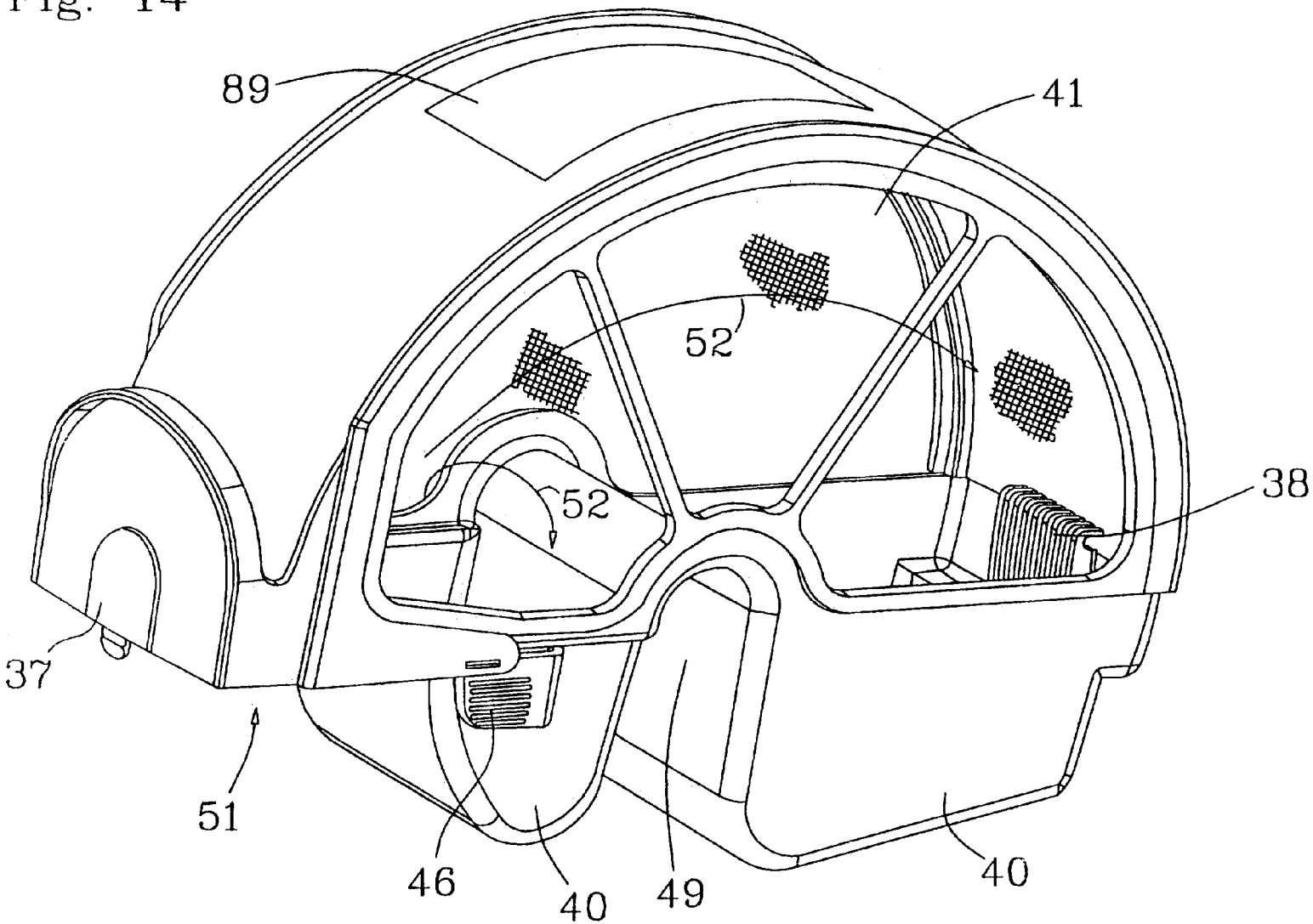
FIG. 14 is an oblique view of the debris collector.
Figure 15:
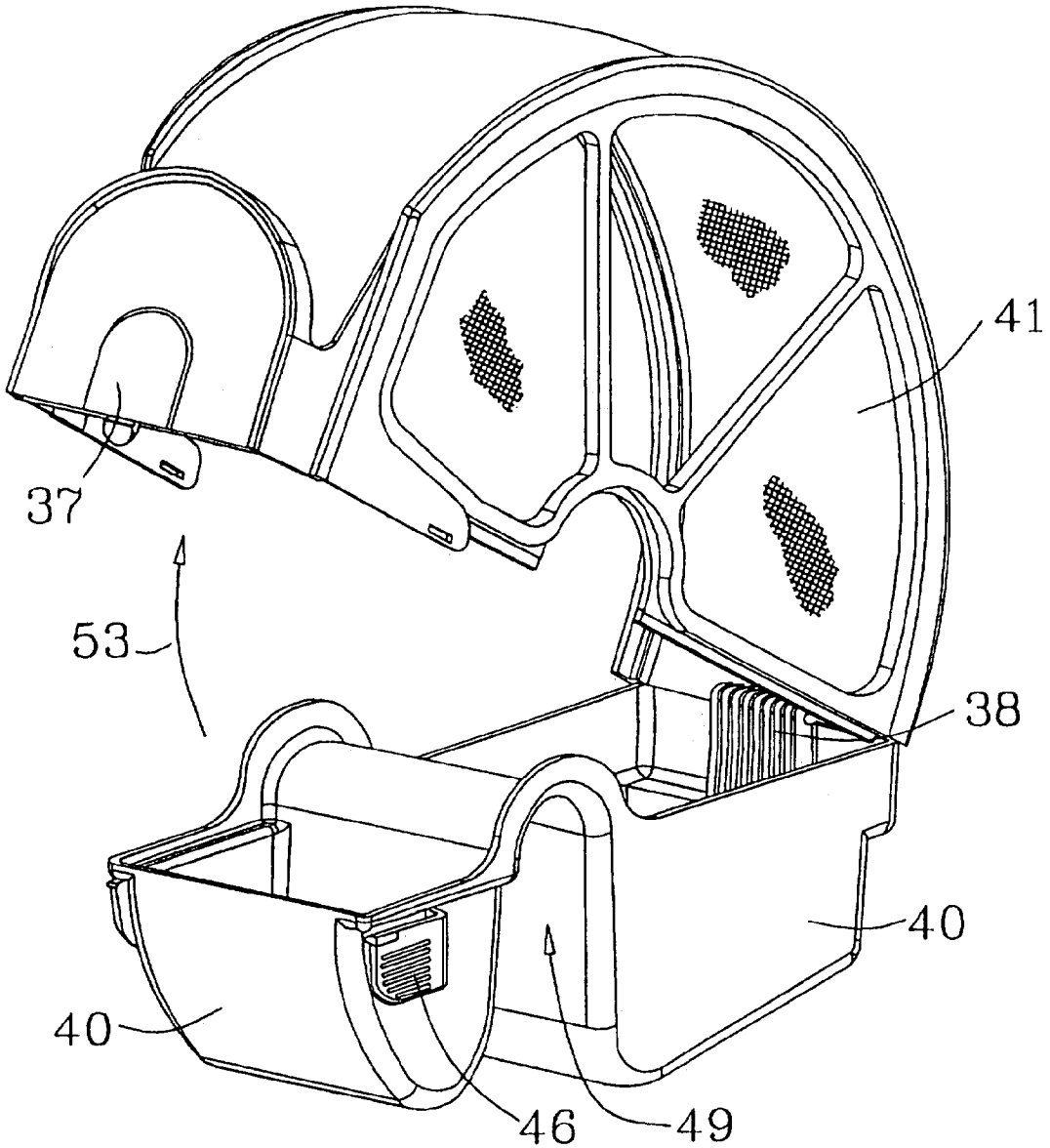
FIG. 15 is a similar oblique view of the debris collector with the sieve portion partially lifted off from the sump portion.

Moving on to FIGS. 14 and 15, these show the debris collector as it appears when removed from the pool cleaner. This will be done by the user of the pool cleaner at intervals when it is necessary to clean out the debris collector. As can be seen and has been described the debris collector comprises a sump 40 having the indentation 49 to allow for the space needed by the bush 35. The clip 37 can be seen by which the unit as shown in FIG. 14 comprising the sump 40 and the sieve portion 41 clips into the pool cleaner, the other end having a detent 58 into which is locked a turnover flange 50 of the pool cleaner in the central zone (see FIGS. 11, 12 and 13).

The exit 48 (FIGS. 11, 12, 13) of the suction passage 13 thus connects to the debris collector and discharges its water and debris at the position indicated by the arrow 51 into the debris collector. The water and debris then follows paths indicated by the arrows 52. Certain debris will thus settle into the sump areas 40 while the water will then exit sideways out of the sieve mesh at 41. The water flow is circular, sweeping past the sieve surfaces, so there may be a self-cleaning effect, at least near the exit 48 of the suction passage 48. It will be noted that the debris collector has a width which is confined to the central region which means that once unclipped it can simply be lifted straight out of the pool cleaner in a convenient way.

FIG. 15 shows how, once the tabs 46 are pressed the sieved portion 41 is released from the sump portion 40 and can initially be hinged upwardly as indicated by the arrow 53 and then disconnected entirely from the formations 38 which hingedly hold the other end initially. The sieved portion sump portion can then be separated entirely to facilitate thoroughly cleaning.

Figure 16:
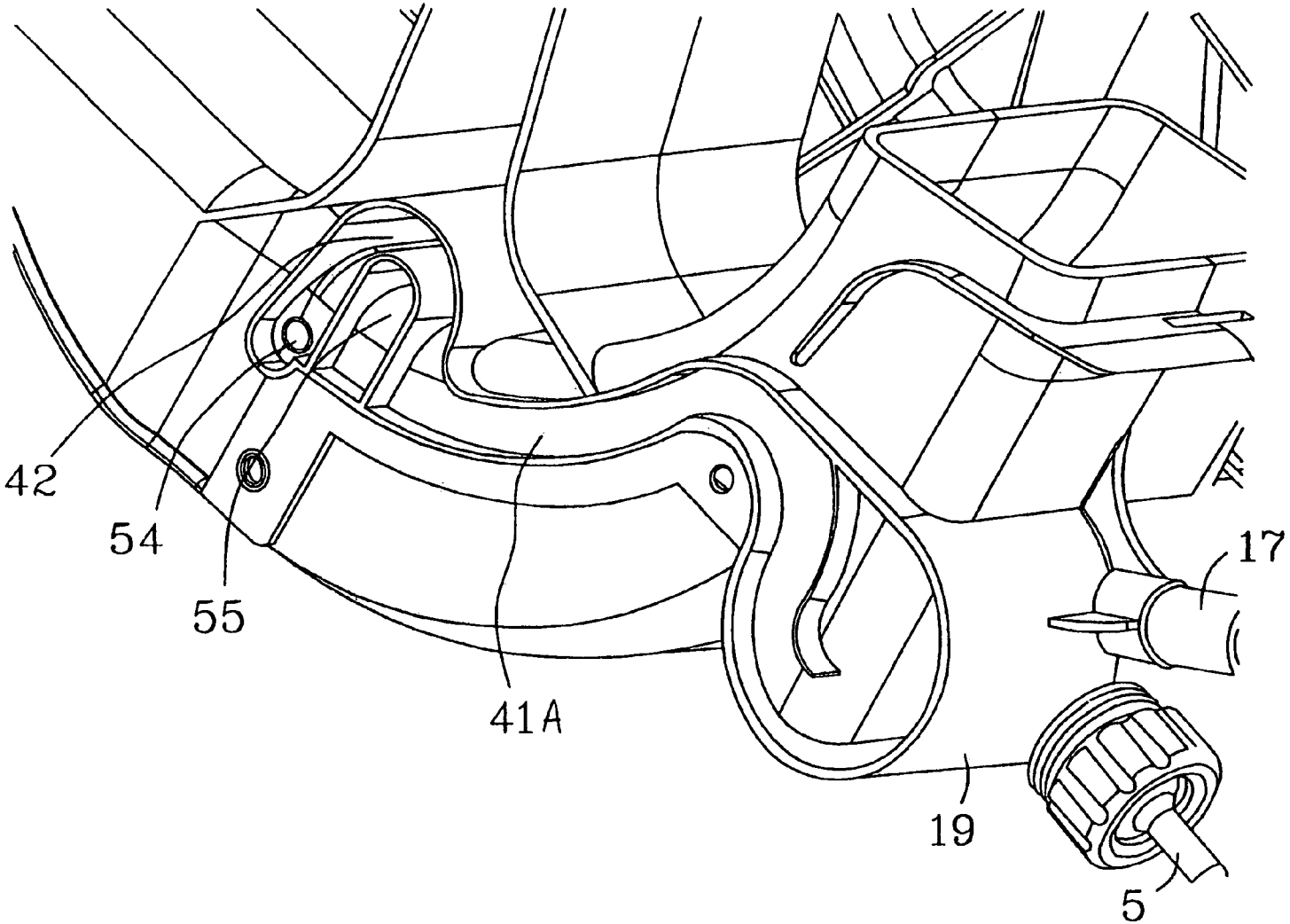
FIG. 16 is an enlarged view of water flow distribution passages with an outer cover removed for convenience of illustration and description.

FIG. 16 shows a detail of the passage 41A with the outer cover of that passage removed for purposes of illustration. This shows how the manifold 19 which receives water from the connection 17 distributes that water to left and right. On the left hand side it enters the passage 41A and moves to the region in which there is a transverse passage 42 which takes the water across to the other side of the central zone in addition to the side on which the passage 41A is located. This water is then fed via the hole 54 to the internal jet which is not seen but which is a mirror image of the jet 43 inside the suction passage 13. Water which has entered from the manifold 19 in the other passage 47 (see FIGS. 10, 12 and 13) comes across to the side of the central zone shown in FIG. 16 via the passage 55. In this way the water is supplied to both sides of the central zone to the two outer jets being the jet 44 and the jet 45.

FIGS. 17 to 22 show a water flow splitter means of the cleaner, seen as a view in the direction of arrow 60 shown in FIG. 5. The water flow splitter comprises two passages 61 and 62 with adjacent or contiguous mouths 63 and 64, respectively. The two passages and mouths are formed by a diametral dividing wall 65 in a circular tube 66.

Figure 19:
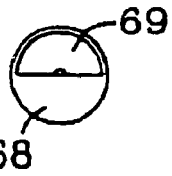
FIG. 19 is a front elevation of the occluding element, removed from the splitter.
Figure 18:
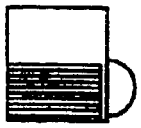
FIG. 18 is a side elevation of an occluding element of the flow splitter, removed from the splitter.
Figure 21:
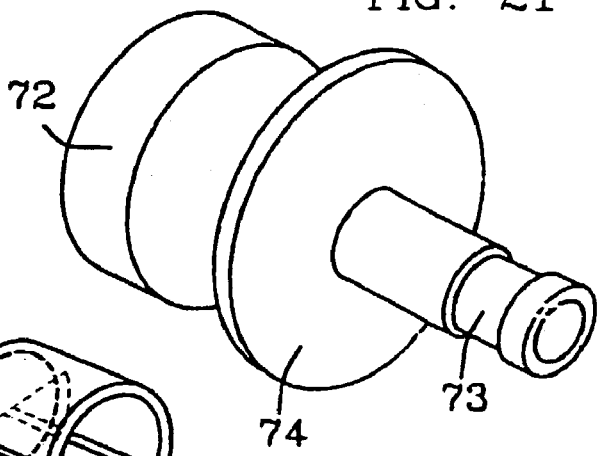
FIG. 21 is an isometric projection of a connector to a push side hose (not shown),unscrewed from the splitter.
Figure 20:
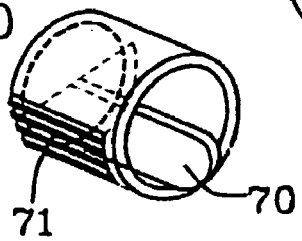
FIG. 20 is an isometric projection of the occluding element, removed from the splitter.

An occluding element 67 shown separately in FIGS. 18, 19 and 20, is cup shaped and rotatably fitted in the tube 66. The bottom 68 of the cup shape is rotatably against the dividing wall 65 and has a semi circular opening 69. A small tab 70 allows the cup shaped element to be lifted out of the tube 66 by finger and thumb. A set of five grooves 71 allow the cup shaped element to be fitted into the tube 66 in anyone of five selectable rotatory positions, which adjusted the division of water between the passages 61 and 62.

Figure 22:
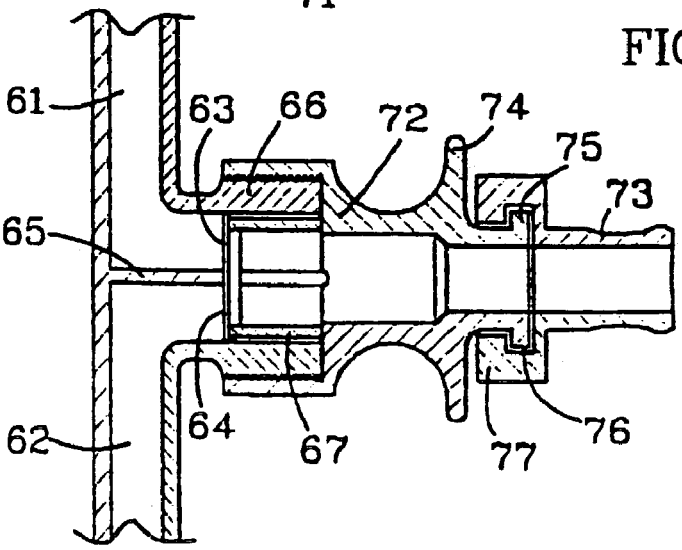
FIG. 22 is an axial cross section on section X—X shown in FIG. 17, of the splitter including occluding element and connector, all connected.

A connector 72 is screwed onto an external screw thread on the tube 66 and holds the occluding element in operative position, as shown in FIG. 22. A flanged formation 74 allows the connector to be used as a handle to lift the cleaner. The connector has a spigot 73 which is shown on a swivel 77, but could be directly onto the connector 72, if preferred.

FIG. 22 shows a swivel connection comprising a flange 75 in the connector 72 and a co-acting groove 76 in a swivel 77 which provides the spigot 73 for connection of a push side hose (not shown). The swivel connector is best located in the connector 72, as shown in FIG. 22, rather than in the pipe or at the pool wall, as is the case with the prior art.

FIG. 22 shows a nozzle 85 which is an alternative, being fixed, to the nozzle 5 described above.

Figure 23:
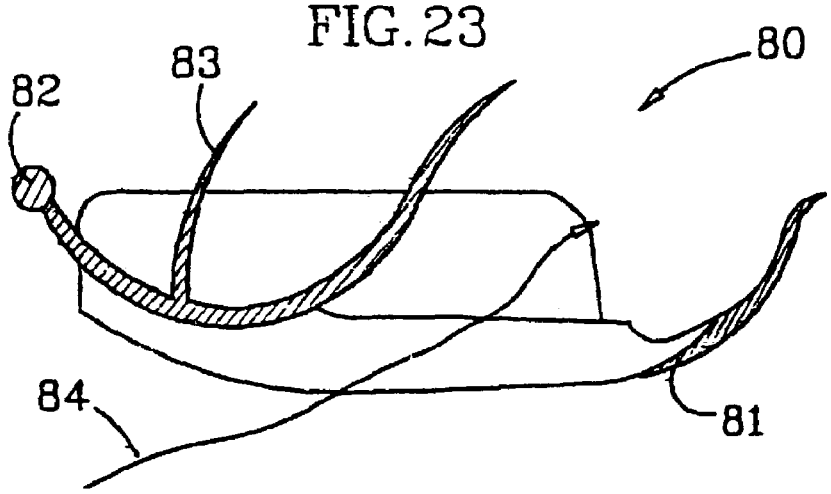
FIG. 23 is a cross sectional side view on section Y—Y shown in FIG. 24, of a movable lip for the mouth of the suction passage, removed from the passage.
Figure 24:
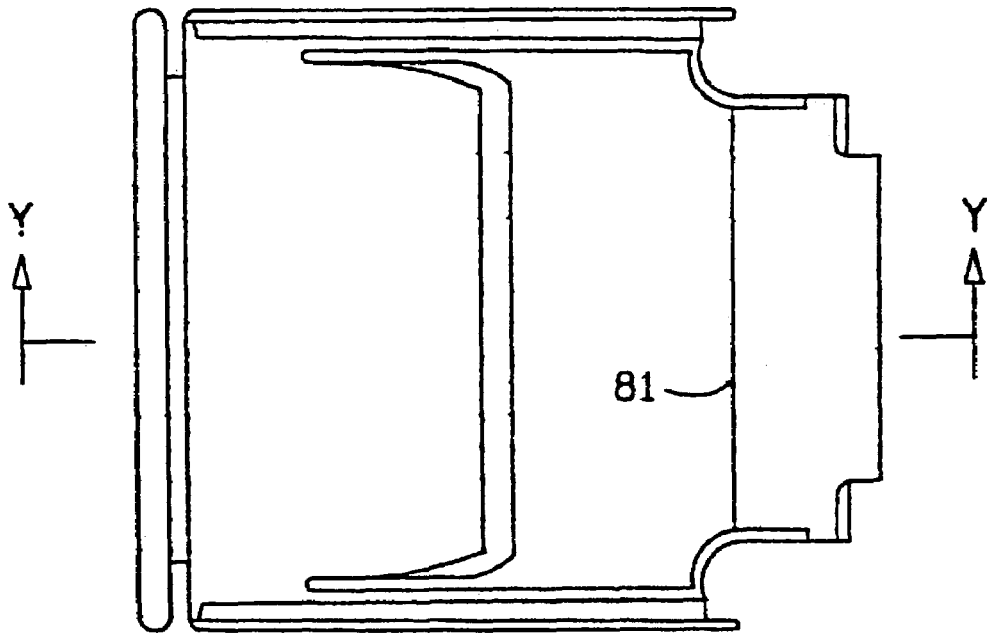
FIG. 24 is a plan view of the movable lip, removed from the passage.

FIGS. 23 and 24 show a structure 80 which provides a movable lip 81 for the mouth of the suction passage. The structure has a shaft 82 which is journalled in the mouth of the cleaner so as to be hingedly mounted. A thin finger-like formation 83 presses against the roof of the mouth when installed and acts as a spring to urge the lip downwards so as to bear against the surface being cleaned. The flow of water inwardly through the structure is indicated by the arrow 84 in FIG. 23. The structure fits in the mouth 39, e.g. as seen in FIGS. 10 and 12.

Figure 25:
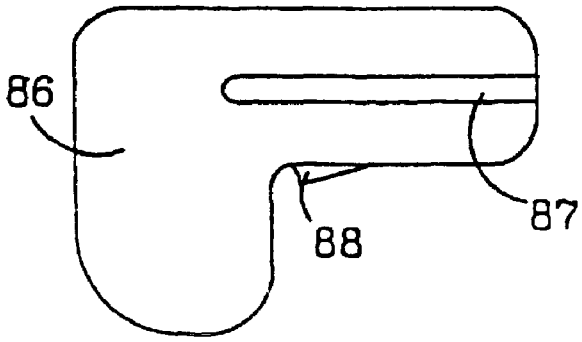
FIGS. 25 and 26 are elevational views of a float used on both sides of the cleaner (see FIGS. 8, 9, 10 and 11).
Figure 26:
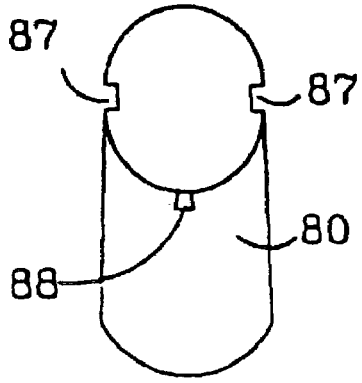

FIGS. 25 and 26 show a float 86 of which two are attached to the cleaner, at a position below the axis of rotation of the axle 36 of the cleaner (see FIGS. 8,9,10 and 11). The float is a moulding in plastic which creates a sealed void filled with air, thus giving a buoyancy force when immersed in water. With two located below the axis of rotation of the axle and hence the wheels of the cleaner (related to the cleaner moving over a pool bottom), they give a force which raises the effective centre of gravity of the cleaner above the axis of rotation, reducing stability under water, creating greater randomness and hence more thorough cleaning.

The floats 86 have grooves 87 on either side and a catch 88, for a sliding fit into the sides of the cleaner and to be retained in position.

FIGS. 5 and 14 show a weight 89 in the form of a rectangle of lead (or similar heavy material), located at the top of the cleaner, relative to its position with its mouth against a pool bottom. This weight raises the centre of gravity of the cleaner to just below the axis of the shaft 36. This high weight combined with the buoyancy forces created by the low floats, one gets the resulting effects which have been described above.

The invention claimed is:

1. An automatic pool cleaner comprising:

a. a body having a width and a rear end;

b. first and second wheels, each having a peripheral edge and a central portion remote from the peripheral edge;

c. an axle spanning the width of the body and connected directly or indirectly to the central portion of each of the first and second wheels, at least a portion of the axle defining an axis about which the first and second wheels rotate;

d. means, positioned on the rear end of the body, for connecting a water-input hose to the body; and e. a jet positioned on and extending outward from the rear end of the body and which, in use, directs water exiting the body to assist movement of the cleaner.

2. An automatic pool cleaner according to claim 1 in which the jet is positioned below the hose connecting means when the body is upright.

3. An automatic pool cleaner according to claim 1 in which the connecting means and the jet are aligned vertically when the body is upright.

4. An automatic pool cleaner according to claim 1 in which the jet directs water rearwardly and downwardly of the body when the body is upright.

5. An automatic pool cleaner according to claim 1 in which the hose connecting means comprises a nipple.

6. An automatic pool cleaner according to claim 1 in which at least one of the first and second wheels is driven.

7. An automatic pool cleaner according to claim 1 in which the axle comprises a linear shaft.

8. An automatic pool cleaner according to claim 1 further comprising a debris-collection mouth, at least a portion of which is positioned at a level lower than the axis when the body is upright.

9. An automatic pool cleaner comprising:

a. a body having a width and a rear end;

b. first and second wheels, each having a peripheral edge and a central portion remote from the peripheral edge;

c. an axle spanning the width of the body and connected directly or indirectly to the central portion of each of the first and second wheels, at least a portion of the axle defining an axis about which the first and second wheels rotate;

d. means, positioned on the rear end of the body, for connecting a water-input hose to the body; and e. a jet (i) positioned on the rear end of the body, (ii) positioned below the axis when the body is upright, and (iii) which, in use, directs water exiting the body to assist movement of the cleaner.

10. An automatic pool cleaner comprising:

a. a body having a width and a rear end;

b. first and second wheels, each having a peripheral edge and a central portion remote from the peripheral edge;

c. an axle spanning the width of the body and connected directly or indirectly to the central portion of each of the first and second wheels, at least a portion of the axle defining an axis about which the first and second wheels rotate;

d. means for connecting a water-input hose to the rear end of the body; and e. a jet positioned on and extending outward from the rear end of the body and which, in use, directs water exiting the body to assist movement of the cleaner.

11. An automatic pool cleaner according to claim 10 in which the jet is positioned below the hose connecting means when the body is upright.

12. An automatic pool cleaner according to claim 10 in which the connecting means and the jet are aligned vertically when the body is upright.

13. An automatic pool cleaner according to claim 10 in which the jet directs water rearwardly and downwardly of the body when the body is upright.

14. An automatic pool cleaner according to claim 10 in which the hose connecting means comprises a nipple.

15. An automatic pool cleaner according to claim 10 in which at least one of the first and second wheels is driven.

16. An automatic pool cleaner according to claim 10 in which the axle comprises a linear shaft.

17. An automatic pool cleaner according to claim 10 further comprising a debris-collection mouth, at least a portion of which is positioned at a level lower than the axis when the body is upright.

18. An automatic pool cleaner comprising:

a. a body having a width and a rear end;

b. first and second wheels, each having a peripheral edge and a central portion remote from the peripheral edge;

c. an axle spanning the width of the body and connected directly or indirectly to the central portion of each of the first and second wheels, at least a portion of the axle defining an axis about which the first and second wheels rotate;

d. means for connecting a water-input hose to the rear end of the body; and e. a jet (i) positioned on the rear end of the body, (ii) positioned below the axis when the body is upright, and (iii) which, in use, directs water exiting the body to assist movement of the cleaner.

19. An automatic pool cleaner comprising:

a. a body having a width and a rear;

b. first and second wheels, each having a peripheral edge and a central portion remote from the peripheral edge;

c. an axle spanning the width of the body and connected directly or indirectly to the central portion of each of the first and second wheels, at least a portion of the axle defining an axis about which at least one of the first and second wheels rotates;

d. means, positioned at the rear of the body, for connecting a water-input hose to the body; and e. a jet (i) positioned at the rear of the body, (ii) positioned below the axis when the body is upright and (iii) which, in use, directs water exiting the body to assist movement of the cleaner.

20. An automatic pool cleaner according to claim 19 in which the axle defines an axis about which the first and second wheels rotate.

* * * * *